US009574567B2

(12) United States Patent
Gadamsetty et al.

(10) Patent No.: US 9,574,567 B2
(45) Date of Patent: Feb. 21, 2017

(54) SUPERSONIC COMPRESSOR AND ASSOCIATED METHOD

(71) Applicant: General Electric Company, Schenectady, NY (US)

(72) Inventors: Rajesh Kumar Venkata Gadamsetty, Bangalore (IN); Chaitanya Venkata Rama Krishna Ongole, Bangalore (IN); Douglas Carl Hofer, Clifton Park, NY (US); Vittorio Michelassi, Munich (DE)

(73) Assignee: General Electric Company, Niskayuna, NY (US)

( * ) Notice: Subject to any disclaimer, the term of this patent is extended or adjusted under 35 U.S.C. 154(b) by 647 days.

(21) Appl. No.: 14/042,881

(22) Filed: Oct. 1, 2013

(65) Prior Publication Data

US 2015/0093232 A1 Apr. 2, 2015

(51) Int. Cl.

| | |
|---|---|
| ***F04D 21/00*** | (2006.01) |
| ***F04D 17/02*** | (2006.01) |
| ***F04D 29/28*** | (2006.01) |
| ***F04D 17/08*** | (2006.01) |

(52) U.S. Cl.

CPC ..... *F04D 21/00* (2013.01); *F04D 17/02* (2013.01); *F04D 17/08* (2013.01); *F04D 29/284* (2013.01)

(58) Field of Classification Search

CPC ..... F04D 17/02; F04D 17/08; F04D 21/00; F04D 29/284

See application file for complete search history.

(56) References Cited

U.S. PATENT DOCUMENTS

| | | | | |
|---|---|---|---|---|
| 2,628,768 | A | 2/1953 | Kantrowitz | |
| 3,356,289 | A * | 12/1967 | Plotkowiak | F04D 21/00 415/149.2 |
| 3,692,425 | A * | 9/1972 | Erwin | F01D 5/146 415/181 |
| 4,123,196 | A * | 10/1978 | Prince, Jr. | F04D 21/00 137/15.2 |

(Continued)

FOREIGN PATENT DOCUMENTS

| | | |
|---|---|---|
| EP | 0375198 A2 | 6/1990 |
| EP | 2447538 A2 | 5/2012 |

OTHER PUBLICATIONS

International Search Report and Written Opinion issued in connection with corresponding PCT Application No. PCT/US2014/052591 on Oct. 24, 2014.

(Continued)

*Primary Examiner* — Woody Lee, Jr.

(74) *Attorney, Agent, or Firm* — Andrew J. Caruso

(57) ABSTRACT

A supersonic compressor rotor and method of compressing a fluid is disclosed. The rotor includes a first and a second rotor disk, a first set and a second set of rotor vanes. The first set and second set of rotor vanes are coupled to and disposed between the first and second rotor disks. Further, the first set of rotor vanes are offset from the second set of rotor vanes. The rotor includes a first set of flow channels defined by the first set of rotor vanes disposed between the first and second rotor disks. Similarly, the rotor includes a second set of flow channels defined by the second set of rotor vanes disposed between the first and second rotor disks. Further, the rotor includes a compression ramp disposed on a rotor vane surface opposite to an adjacent rotor vane surface.

17 Claims, 8 Drawing Sheets

(56) References Cited

U.S. PATENT DOCUMENTS

| | | | | |
|---|---|---|---|---|
| 4,178,667 | A | 12/1979 | Stevens et al. | |
| 4,315,714 | A | 2/1982 | Exley et al. | |
| 4,408,957 | A * | 10/1983 | Kurzrock | F04D 21/00 415/181 |
| 4,502,837 | A * | 3/1985 | Blair | F01D 5/045 415/198.1 |
| 5,554,000 | A | 9/1996 | Katoh et al. | |
| 5,642,985 | A | 7/1997 | Spear et al. | |
| 6,358,012 | B1 * | 3/2002 | Staubach | F01D 5/141 416/228 |
| 2005/0249578 | A1 | 11/2005 | LeBlanc et al. | |
| 2010/0329856 | A1 * | 12/2010 | Hofer | F04D 21/00 415/181 |

OTHER PUBLICATIONS

Creagh et al., "Utilization of External-Compression Diffusion Principle in Design of Shock—In-Rotor Supersonic Compressor Blading", National Advisory Committee for Aeronautics, NACA RM E53F18,1953, 39 Pages.

* cited by examiner

SUPERSONIC COMPRESSOR AND ASSOCIATED METHOD

BACKGROUND

The present invention relates generally to a compressor, and more particularly to a rotor of a supersonic compressor.

Compressors are used to compress fluids and are widely used in systems ranging from refrigeration units to jet engines. During operation, the compressor applies mechanical energy to a fluid at lower pressure to raise pressure of the fluid to higher pressure. Compression of the fluid is ether performed in a single stage or in multiple stages. Currently available compression technology varies from centrifugal compression systems to mixed flow compression systems, to axial flow compression systems. The performance of the compressor may be measured by a pressure ratio of the fluid before and after a compression stage. Typically, the pressure ratio achieved in single stage compression is relatively low. Higher pressure ratios are achievable by multistage compression. However, compressors having multiple stages tend to be large, complex and of high cost.

Supersonic compressors are believed to overcome some of the limitations of conventional compressors. In such supersonic compressors, compression is performed by contacting an inlet fluid with a moving rotor having a plurality of rotor vanes which moves the inlet fluid from a low pressure side of the rotor to a high pressure side of the rotor. Generally, in such supersonic compressors, the velocity of the fluid at the high pressure side of the rotor is reduced to subsonic velocity due to generation of a normal shockwave within flow channels defined by the plurality of rotor vanes. An interaction of the normal shockwave with a boundary layer in the flow channels results in a local flow separation of the compressed fluid. Such local flow separation results in reduction of an overall operating efficiency of the compressor. Thus, there is a need for an enhanced supersonic compressor.

BRIEF DESCRIPTION

In accordance with one exemplary embodiment, a supersonic compressor rotor is disclosed. The supersonic compressor rotor includes a first rotor disk and a second rotor disk. Further, the supersonic compressor rotor includes a first set of rotor vanes coupled to and disposed between the first and second rotor disks and defining together with the first and second rotor disks, a first set of flow channels. The supersonic compressor rotor further includes a second set of rotor vanes coupled to and disposed between the first and second rotor disks and defining together with the first and second rotor disks, a second set of flow channels. The first set of rotor vanes is disposed offset from the second set of rotor vanes and the first set of flow channels and the second set of flow channels are configured such that each flow channel of the first set of flow channels is in fluid communication with at least one flow channel of the second set of flow channels. Further, the supersonic compressor rotor includes a plurality of compression ramps configured such that each compression ramp is disposed on a rotor vane surface opposite an adjacent rotor vane surface.

In accordance with one exemplary embodiment, a supersonic compressor is disclosed. The supersonic compressor includes a casing having a fluid inlet and a fluid outlet and a rotor shaft. Further, the supersonic compressor includes at least one supersonic compressor rotor disposed within the casing. The supersonic compressor rotor includes a first rotor disk and a second rotor disk coupled to the first rotor disk and the rotor shaft. Further, the supersonic compressor rotor includes a first set of rotor vanes coupled to and disposed between the first and second rotor disks and defining together with the first and second rotor disks, a first set of flow channels. The supersonic compressor rotor further includes a second set of rotor vanes coupled to and disposed between the first and second rotor disks and defining together with the first and second rotor disks, a second set of flow channels. The first set of rotor vanes is disposed offset from the second set of rotor vanes and the first set of flow channels and the second set of flow channels are configured such that each flow channel of the first set of flow channels is in fluid communication with at least one flow channel of the second set of flow channels. Further, the supersonic compressor rotor includes a plurality of compression ramps configured such that each compression ramp is disposed on a rotor vane surface opposite an adjacent rotor vane surface.

In accordance with one exemplary embodiment, a method of compressing a fluid is disclosed. The method includes introducing a first fluid into at least one flow channel of a first set of flow channels of a supersonic compressor rotor configured to be driven by a shaft. Further, the method includes performing a first compression of the first fluid in the at least one flow channel of the first set of flow channels, to produce a second fluid. The method further includes introducing the second fluid into at least one flow channel of a second set of flow channels of the supersonic compressor rotor. Further, the method includes performing a second compression of the second fluid in the at least one flow channel of the second set of flow channels, to produce a further compressed second fluid. The further compressed second fluid is characterized by a higher pressure than the second fluid, the first set of first flow channels is defined by adjacent rotor vanes of a first set of rotor vanes, the second set of second flow channels is defined by adjacent rotor vanes of a second set of rotor vanes, each flow channel of the first set and second set of flow channels is further defined by a compression ramp disposed on a rotor vane surface opposite an adjacent rotor vane surface, and the first set and second set of rotor vanes are coupled to and disposed between a first rotor disk and a second rotor disk.

DRAWINGS

These and other features and aspects of embodiments of the present disclosure will become better understood when the following detailed description is read with reference to the accompanying drawings in which like characters represent like parts throughout the drawings, wherein.

DETAILED DESCRIPTION

Figure 1:
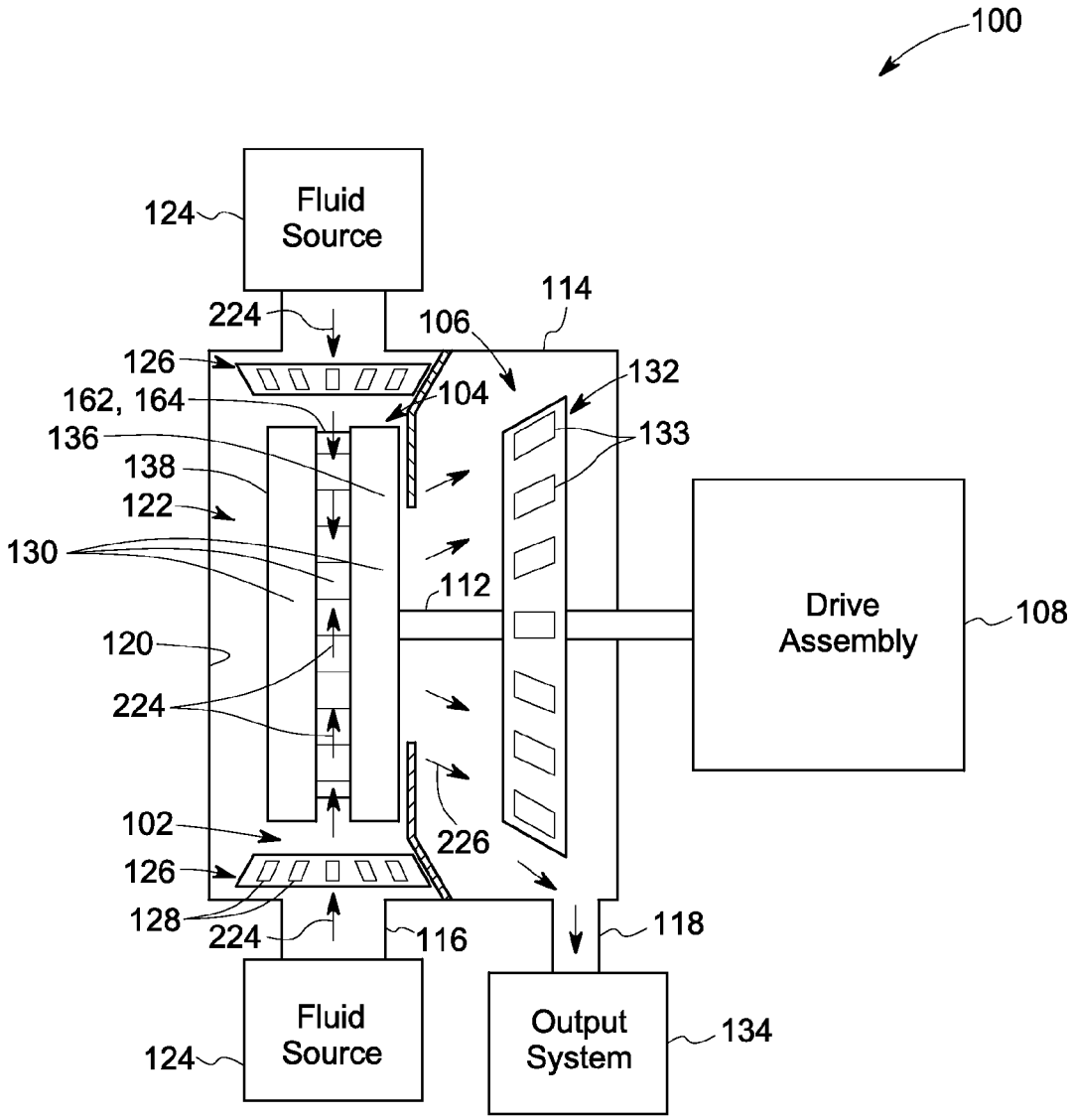
FIG. 1 is a schematic view of a supersonic compressor in accordance with one exemplary embodiment.

While only certain features of embodiments of the invention have been illustrated and described herein, many modifications and changes will occur to those skilled in the art. It is therefore to be understood that the appended claims are intended to cover all such modifications and changes as fall within the spirit of the invention.

As used herein, the term a "supersonic compressor" is referred to a compressor comprising a supersonic compressor rotor. The supersonic compressor may include one or more supersonic compressor rotors configured to compress a fluid which flows radially inward or outward between a plurality of rotor vanes disposed between a pair of rotor disks. In such a supersonic compressor, the fluid is transported from a low pressure side of a fluid conduit to between the plurality of rotor vanes and then to a high pressure side of the fluid conduit.

The supersonic compressor rotor is referred to as "supersonic" because such a rotor comprises compression ramps and is designed to rotate about an axis at higher speeds such that a flow of fluid, encountering a compression ramp of the rotor, has a relative fluid velocity, which is supersonic. The relative fluid velocity may be defined as a vector sum of a rotor velocity at a leading edge of the compression ramp and a fluid velocity just prior to encountering the leading edge of the compression ramp. Additionally, the relative fluid velocity may also be referred to as a "local supersonic inlet velocity" which in certain embodiments is a combination of an inlet fluid velocity and a tangential speed of the compressor rotor at a fluid inlet of the compressor. The supersonic compressor rotors are operated at very high tangential speeds, for example tangential speeds in a range of 250 meters/second to 800 meters/second.

In one embodiment, the exemplary supersonic compressor may be used within a larger system, for example a gas turbine engine or a jet engine. The overall size and weight of a gas turbine engine may be reduced due to the enhanced compression ratios attainable by the supersonic compressor. Embodiments discussed herein enhance the efficiency of the supersonic compressor by restricting generation of normal shockwaves at the downstream end of each rotor vane of the second set of rotor vanes. Further, the embodiments detailed above decreases the propensity of the compressed fluid to experience a local flow separation due to a weaker interaction of a boundary layer with the normal shock waves.

Embodiments discussed herein disclose rotors for supersonic compressors and a method of compressing a fluid. In one or more embodiments, the present invention provides a supersonic compressor comprising a supersonic compressor rotor. The supersonic compressor rotor includes two sets of rotor vanes disposed between a pair of rotor disks. The first set of rotor vanes and the pair of rotor disks defines a first set of flow channels. The second set of rotor vanes and the pair of rotor disks defines a second set of flow channels. Further, a plurality of compression ramps is configured such that each compression ramp is disposed on a rotor vane surface opposite an adjacent rotor vane surface. The compression ramps are configured to generate oblique shockwaves within each flow channel of the first set and second set of flow channels. Further, in such supersonic compressors, the generation of a normal shockwave is restricted to an end of each flow channel of the second set of flow channels. The normal shockwave causes reduction in velocity of the compressed fluid to a subsonic velocity only at the end of each flow channel of the second set of flow channels.

FIG. 1 is a schematic view of an exemplary supersonic compressor 100 comprising an intake section 102, a compressor section 104 disposed downstream from the intake section 102, a discharge section 106 disposed downstream from the compressor section 104, and a drive assembly 108. The compressor section 104 is coupled to the drive assembly 108 via a rotor shaft 112. In the exemplary embodiment, each of the intake section 102, the compressor section 104, and the discharge section 106 are positioned within a casing 114. More specifically, the casing 114 includes a fluid inlet 116, a fluid outlet 118, and an inner surface 120 that defines a cavity 122. The cavity 122 extends between the fluid inlet 116 and the fluid outlet 118 and defines a flow path for a fluid from the fluid inlet 116 to the fluid outlet 118. Each of the intake section 102, the compressor section 104, and the discharge section 106 are positioned within the cavity 122. Alternatively, the intake section 102 and/or the discharge section 106 may not be positioned within the casing 114.

In the illustrated exemplary embodiment, the intake section 102 includes an inlet guide vane assembly 126 comprising one or more inlet guide vanes 128 for directing a first fluid 224 from the fluid inlet 116 to the compressor section 104. The compressor section 104 includes at least one supersonic compressor rotor 130 that is coupled to the rotor shaft 112. The supersonic compressor rotor 130 is configured for radial compression of the first fluid 224 and includes a first rotor disk 136, a second rotor disk 138, and a first set and a second set of rotor vanes 162, 164. In the illustrated embodiment, the supersonic compressor 100 is configured for a single stage compression of the first fluid 224. The discharge section 106 includes an outlet guide vane assembly 132 having one or more outlet guide vanes 133 for directing a compressed second fluid 226 from the compressor section 104 to the fluid outlet 118. The drive assembly 108 drives the supersonic compressor rotor 130 via the rotor shaft 112. In other embodiments, the compressor section 104 may include more than one supersonic compressor rotor 130 and be configured for a multi stage compression of the first fluid 224.

In the exemplary embodiment, the fluid inlet 116 defines a flow path for the first fluid 224 from a fluid source 124 to the intake section 102. The first fluid 224 may be any fluid such as, for example a gas or a gas mixture. The intake section 102 defines a flow path for the flow of first fluid 224 from the fluid inlet 116 to the compressor section 104. The compressor section 104 compresses the first fluid 224 and discharges the compressed second fluid 226 to the discharge section 106. The outlet guide vane assembly 132 of the discharge section 106 defines a flow path for the compressed second fluid 226 from the supersonic compressor rotor 130 to the fluid outlet 118. The fluid outlet 118 feeds the compressed second fluid 226 to an output system 134 such as, for example, a turbine engine system, a fluid treatment system, and/or a fluid storage system.

Figure 2:
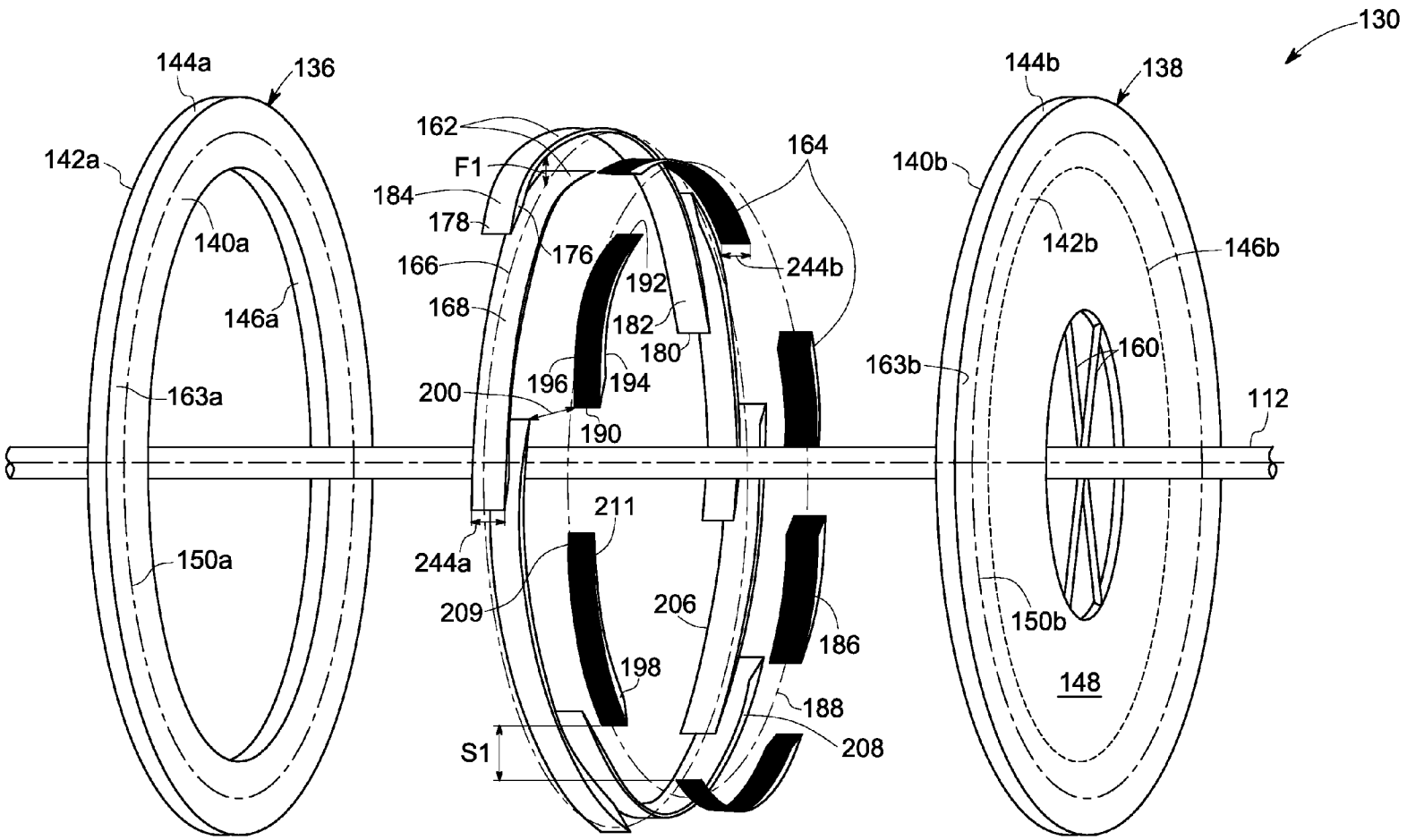
FIG. 2 represents an exploded view of a supersonic compressor rotor in accordance with one exemplary embodiment.

FIG. 2 illustrates an exploded view of a supersonic compressor rotor 130 in accordance with an exemplary embodiment. The supersonic compressor rotor 130 includes a first rotor disk 136, a second rotor disk 138, a first set of rotor vanes 162, a second set of rotor vanes 164, and a rotor shaft 112.

In the illustrated exemplary embodiment, the first rotor disk 136 includes a first radial surface 144*a*, a second radial surface 146*a*, and a body 163*a* extending between the first radial surface 144*a* and the second radial surface 146*a*. The body 163*a* has an inner surface 140*a* and an outer surface 142*a*.

In the illustrated exemplary embodiment, the second rotor disk 138 includes a first radial surface 144*b*, a second radial surface 146*b*, and a body 163*b* extending between the first radial surface 144*b* and the second radial surface 146*b*. The body 163*b* has an inner surface 140*b* and an outer surface 142*b*. The second rotor disk 138 further includes an end wall 148 coupled to the second radial surface 146*b*. Further, the end wall 148 is coupled to a plurality of rotor support struts 160 which are in turn coupled to the rotor shaft 112. In the exemplary embodiment, the first rotor disk 136 is coupled to the second rotor disk 138 via the first set and second set of rotor vanes 162, 164. In certain other embodiments, the first rotor disk 136 may be directly coupled to the rotor shaft 112 for example via the plurality of rotor support struts 160. It should be noted herein that the coupling of the rotor shaft 112 to the first rotor disk 136 or the second rotor disk 138 may vary depending on the application and design criteria.

In the illustrated exemplary embodiment, a first circumferential axis 166 serves as a geometric reference for positioning the first set of rotor vanes 162. For example, in one embodiment, the first circumferential axis 166 passes through a midpoint 168 of each rotor vane 162. It should be noted that first circumferential axis 166 is defined between the first radial surface 144*a* and the second radial surface 146*a* of the first rotor disk 136 and between the first radial surface 144*b* and the second radial surface 146*b* of the second rotor disk 138. Each rotor vane 162 is spaced apart from adjacent vanes 162 by a gap F1. In the illustrated embodiment, the first set of rotor vanes 162 includes six rotor vanes, each of which has a leading edge 178 and a trailing edge 180. The leading edge 178 is positioned proximate to the first radial surfaces 144*a*, 144*b* of the first and second rotor disks 136, 138 respectively. Similarly, the trailing edge 180 is positioned proximate to second and third circumferential axes 150*a*, 150*b* of the first and second rotor disks 136, 138 respectively. In the embodiment shown, the second circumferential axis 150*a* is defined along a set of midpoints between the first radial surface 144*a* and the second radial surface 146*a* of the first rotor disk 136. Similarly, the third circumferential axis 150*b* is defined along a set of midpoints between the first radial surface 144*b* and the second radial surface 146*b* of the second rotor disk 138. In the illustrated exemplary embodiment, each rotor vane 162 includes a pressure side vane surface 182 and a suction side vane surface 184. In one embodiment, at least one rotor vane 162 comprises only one compression ramp 176. In the embodiment shown, each rotor vane 162 comprises one compression ramp 176 on the pressure side vane surface 182 opposite to the suction side vane surface 184 of adjacent rotor vanes 162. Specifically, compression ramp 176 is positioned at the leading edge 178 of each rotor vane 162. Further, each rotor vane 162, has a vane inner side 206, a vane outer side 208, and a height 244*a* measured from the vane inner side 206 and the vane outer side 208.

In the illustrated exemplary embodiment, a fourth circumferential axis 188 serves as a geometric reference for positioning the second set of rotor vanes 164. For example, in one embodiment, the fourth circumferential axis 188 passes through a midpoint 186 of each rotor vane 164. Each rotor vane 164 is spaced apart from adjacent vanes 164 by a gap S1. In the illustrated embodiment, the second set of rotor vanes 164 includes six rotor vanes, each of which has a leading edge 190 and a trailing edge 192. The leading edge 190 is positioned proximate to the trailing edge 180 of each adjacent rotor vane 162. It should be noted herein that the term "proximate" means there are no intervening vanes between the leading edge 190 and the trailing edge 180. Similarly, the trailing edge 192 is positioned proximate to the second radial surfaces 146*a*, 146*b* of the first and second rotor disks 136, 138 respectively. In the illustrated exemplary embodiment, each rotor vane 164 includes a pressure side vane surface 194 and a suction side vane surface 196. In one embodiment, at least one rotor vane 164 comprises only one compression ramp 198. In the embodiment shown, each rotor vane 164 comprises a compression ramp 198 on the pressure side vane surface 194 opposite to the suction side vane surface 196 of adjacent rotor vanes 164. Specifically, compression ramp 198 is positioned at the leading edge 190 of each rotor vane 164. Further, each rotor vane 164, has a vane inner side 209, a vane outer side 211, and a height 244*b* measured from the vane inner side 209 and the vane outer side 211. It should be noted herein that the number of rotor vanes in the first set of rotor vanes 162 and the second set of rotor vanes 164 are same In the illustrated exemplary embodiment, the compression ramps 176, 198 are integral to the first set and second set of rotor vanes 162, 164 respectively. Rotor vanes comprising such integral compression ramps can be manufactured for example, by casting from a molten metal or by machining the rotor vane from a single piece of metal. In certain other embodiments, the compression ramps 176, 198 are not integral to the first set and second set of rotor vanes 162, 164 respectively. In such embodiments, each rotor vane and the corresponding compression ramp are created separately and later joined.

In the illustrated exemplary embodiment, each rotor vane 162 is disposed offset by a distance 200 from adjacent rotor vane 164. It should be noted herein that the term "offset" means the leading edge 190 of each rotor vane 164 is disposed by an "offset distance" from the trailing edge 180 of adjacent rotor vane 162. In the exemplary embodiment, the offset distance 200 may be in a range of 1 percent to 15 percent of a diameter of the first set of rotor vanes 162, at the leading edge 178. The offset distance 200 between the first set of rotor vanes 162 and the second set of rotor vanes 164 may vary depending on the application and design criteria.

In the exemplary embodiment, each rotor vane 162 has a height 244*a* equal to approximately one-tenth of the length of each rotor vane 162. Each rotor vane 164 has a height 244*b* equal to approximately one-sixth of the length of each rotor vane 164. Each rotor vane 164 has a length equal to about three-fourths of the length of adjacent rotor vane 162.

In certain embodiments, the supersonic compressor rotor 130 may be manufactured using any suitable materials for example, aluminum, aluminum alloys, steel, steel alloys, nickel alloys, and titanium alloys, depending on design requirements. In some embodiments, composite structures may also be used which combine the relative strengths of several different materials including those listed above and non-metallic materials. The compressor casings, inlet guide vanes, and outlet guide vanes may be made of any suitable material including cast iron. In certain embodiments, supersonic compressor rotor components may be prepared by metal casting techniques and/or machining.

Figure 3:
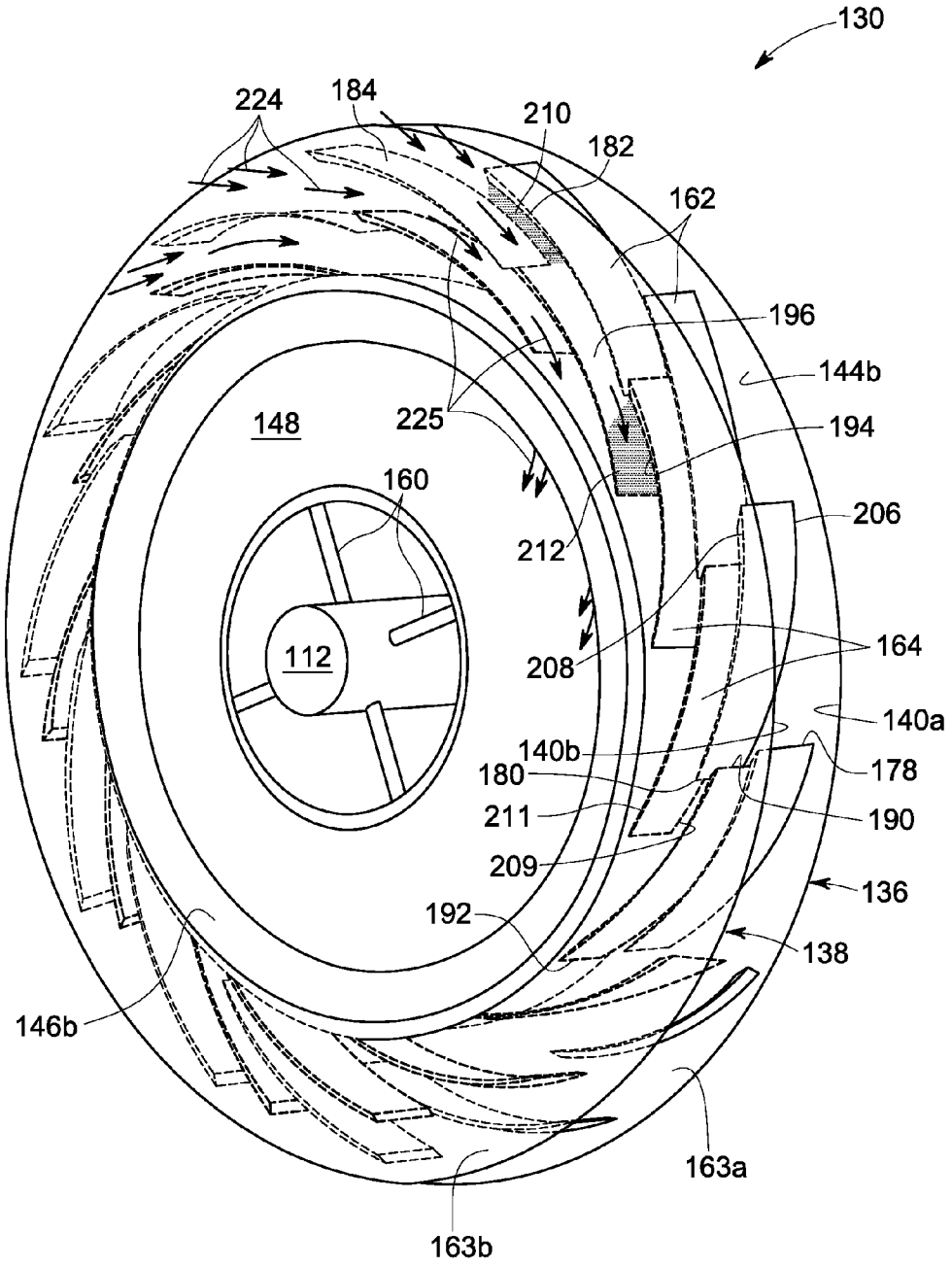
FIG. 3 represents a perspective view of an assembled supersonic compressor rotor in accordance with one exemplary embodiment.

FIG. 3 represents a perspective view of an assembled supersonic compressor rotor 130 in accordance with an exemplary embodiment in which the first set of rotor vanes 162 and the second set of rotor vanes 164 are disposed between the first rotor disk 136 and the second rotor disk 138, and each rotor vane 162, 164 is coupled to the inner surfaces 140*a* and 140*b* of the bodies 163*a* and 163*b* of the rotor disks 136 and 138 respectively via the vane inner sides 206 and 209 and the vane outer sides 208 and 211. In the exemplary embodiment, the first set of rotor vanes 162 and the second set of rotor vanes 164 may be welded to the bodies 163*a*, 163*b* respectively of each rotor disk 136, 138. In another embodiment, the first set of rotor vanes 162 and the second set of rotor vanes 164 may be coupled via complementary grooves i.e. a dovetail slot defined on the bodies 163*a*, 163*b* and a slot defined in the rotor vanes 162, 164, or vice versa. In yet another embodiment, the first set and second set of rotor vanes 162, 164 may be integrated to the bodies 163*a*, 163*b* by machining a single piece of a material. The leading edge 178 of each rotor vane 162 is disposed proximate to the first radial surfaces 144*a* (as shown in FIG. 2), 144*b*. The leading edge 190 of each rotor vane 164 is disposed proximate to the trailing edge 180 of each adjacent rotor vane 162. The trailing edge 192 of each rotor vane 164 is disposed proximate to the second radial surfaces 146*a* (as shown in FIG. 2), 146*b*.

In the illustrated exemplary embodiment, a first set of flow channels 210 is defined by adjacent rotor vanes 162 and the first and second rotor disks 136, 138. Similarly, a second set of flow channels 212 is defined by adjacent rotor vanes 164 and the first and second rotor disks 136, 138. More particularly, each flow channel 210 is formed between the pressure side vane surface 182 of each rotor vane 162 and the suction side vane surface 184 of adjacent rotor vane 162. Similarly, each flow channel 212 is formed between the pressure side vane surface 194 of each rotor vane 164 and the suction side vane surface 196 of adjacent rotor vane 164.

The plurality of rotor support struts 160 are coupled to the rotor shaft 112 and the second rotor disk 138 via the end wall 148. The first rotor disk 136 is coupled to the second rotor disk 138 via the first set and second set of rotor vanes 162, 164.

Figure 4:
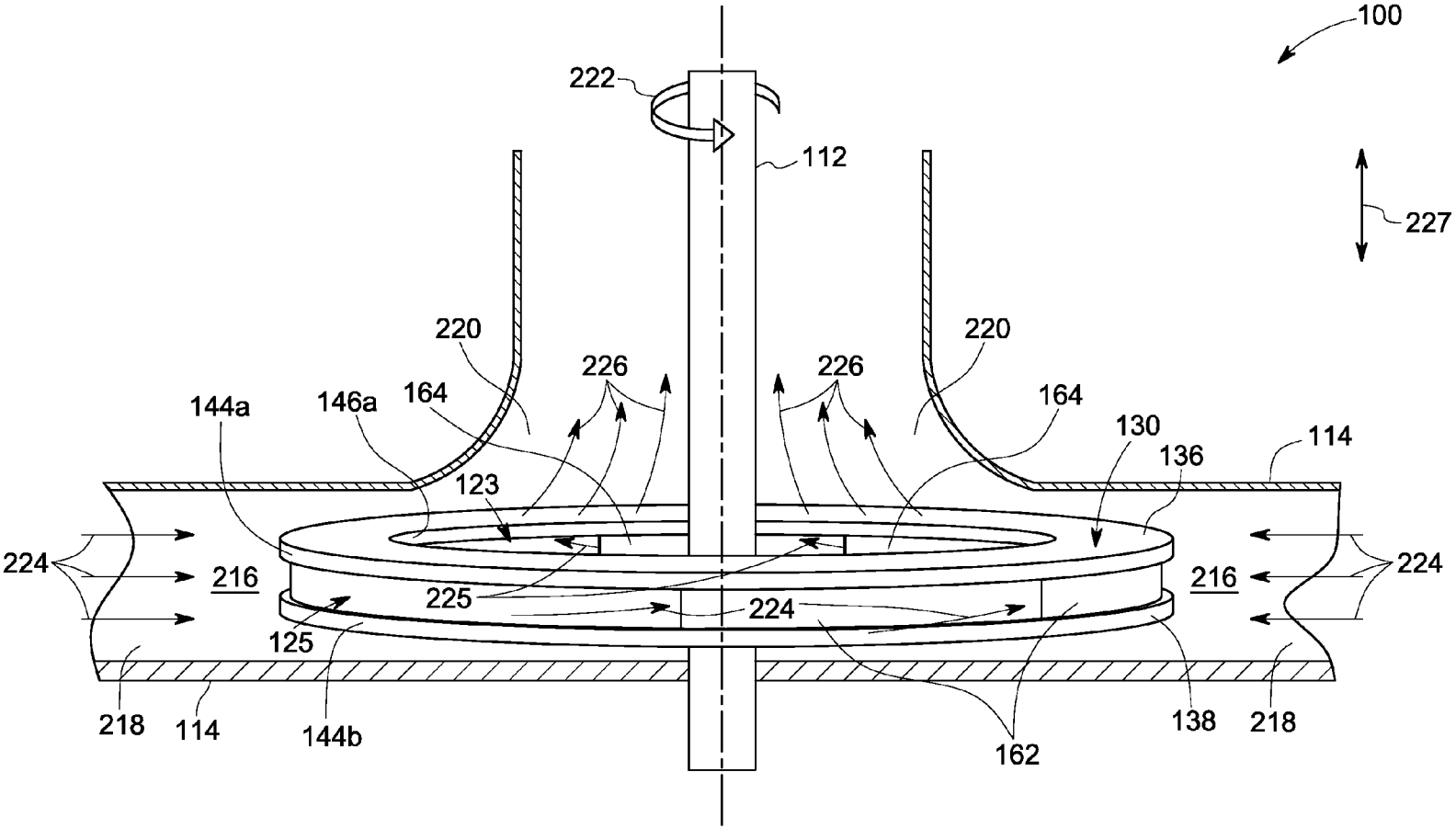
FIG. 4 represents a partial perspective view of a portion of a supersonic compressor in accordance with one exemplary embodiment.

FIG. 4 represents a perspective view of a portion of a supersonic radial flow compressor 100. In the illustrated exemplary embodiment, the supersonic compressor rotor 130 is disposed within a fluid conduit 216 of the supersonic compressor 100. The fluid conduit 216 defined by the compressor casing 114, includes a low pressure side 218 and a high pressure side 220. The supersonic compressor rotor 130 disposed within the compressor casing 114, is driven by the rotor shaft 112 in a direction as indicated by reference numeral 222.

When the drive shaft 112 is rotated, the first fluid 224 introduced through the fluid inlet 116 (as shown in FIG. 1), enters the low pressure side 218 of the fluid conduit 216, and is directed radially inwards into each flow channel 210 (e.g. as shown in FIG. 3). The first fluid 224 is compressed i.e. undergoes a first compression within each flow channel 210 due to generation of the oblique shockwave created by the compression ramp 176 (e.g. as shown in FIG. 2) so as to produce the second fluid 225. In the exemplary embodiment, the second fluid 225 then enters at least one flow channel 212 (e.g. as shown in FIG. 3). The second fluid 225 is further compressed i.e. undergoes a second compression within each flow channel 212 due to generation of the oblique shockwave created by the compression ramp 198 (e.g. as shown in FIG. 2) so as to produce a further compressed second fluid 226. It should be noted herein that the terms "compressed second fluid" and "further compressed second fluid" are used interchangeably.

The further compressed second fluid 226 then exits along a direction 227 via the high pressure side 220 of the fluid conduit 216. The further compressed second fluid 226 within the high pressure side 220 of the fluid conduit 216 may be used to perform work.

The supersonic compressor 100 is configured for an outside-in compression of the first fluid 224. During operation, the rotation of the supersonic compressor rotor 130 directs the flow of the first fluid 224 from the first radial surfaces 144*a*, 144*b* of the first and second rotor disks 136, 138 respectively, through the first set and second set of flow channels 210, 212 (e.g. as shown in FIG. 3) to an inner cylindrical space 123. In some other embodiments, the supersonic compressor 100 may be configured for an inside-out compression of the first fluid 224. In such embodiments, the rotation of the supersonic compressor rotor 130 moves the first fluid 224 from the second radial surfaces 146*a*, 146*b* (e.g. as shown in FIG. 2) of the first and second rotor disks 136, 138 respectively, through the second set and the first set of flow channels 212, 210 (e.g. as shown in FIG. 3) to an outer cylindrical space 125.

Figure 5:
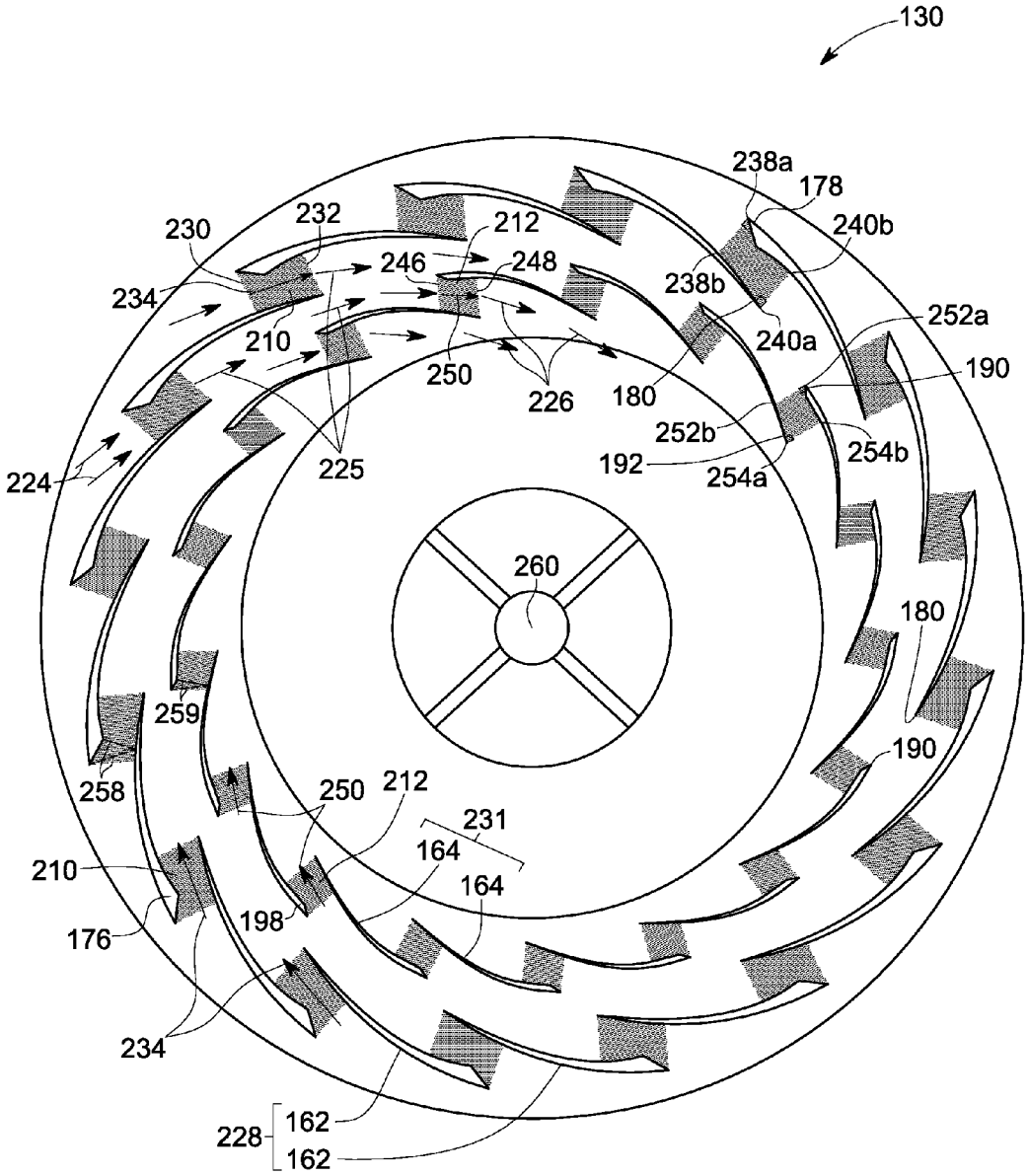
FIG. 5 is a schematic diagram of a supersonic compressor rotor in accordance with one exemplary embodiment.

FIG. 5 is a schematic diagram of a supersonic compressor rotor 130 in accordance with an exemplary embodiment. The supersonic compressor rotor 130 includes first set of rotor vanes 162 and second set of rotor vanes 164. In the exemplary embodiment, adjacent rotor vanes 162 form a first pair of rotor vanes 228 and adjacent rotor vanes 164 form a second pair of rotor vanes 231. In the embodiment shown herein, the first set of rotor vanes 162 includes sixteen rotor vanes and the second set of rotor vanes 164 includes seventeen rotor vanes.

The first pair of rotor vanes 228 defines a first inlet opening 230, a first outlet opening 232, and the flow channel 210. Each flow channel 210 extends between the first inlet opening 230 and the first outlet opening 232 and defines a first flow path represented by arrow 234. The first inlet opening 230 is defined between an inlet edge 238*a* positioned at the leading edge 178 of each rotor vane 162 and an inlet edge 238*b* positioned perpendicularly from the inlet edge 238*a* on adjacent rotor vane 162. Thus, an imaginary line between inlet edges 238*a* and 238*b* will be perpendicular to the surface of the rotor vane 162. The first outlet opening 232 is defined between an outlet edge 240*a* positioned at the trailing edge 180 of each rotor vane 162 and an outlet edge 240*b* positioned perpendicularly from the outlet edge 240*a* on adjacent rotor vane 162. Each flow channel 210 is sized, shaped, and oriented to direct the first fluid 224 along the first flow path 234 from the first inlet opening 230 to the first outlet opening 232

The second pair of rotor vanes 231 defines a second inlet opening 246, a second outlet opening 248, and the flow channel 212. Each flow channel 212 extends between the second inlet opening 246 and the second outlet opening 248 and defines a second flow path represented by arrow 250. The second inlet opening 246 is defined between an inlet edge 252*a* positioned at the leading edge 190 of each rotor vane 164 and an inlet edge 252*b* positioned perpendicularly from the inlet edge 252*a* on adjacent rotor vane 164. The second outlet opening 248 is defined between an outlet edge 254*a* positioned at the trailing edge 192 of each rotor vane 164 and an outlet edge 254*b* positioned perpendicularly from the outlet edge 254*a* on adjacent rotor vane 164. Each flow channel 212 is sized, shaped, and oriented to channel the second fluid 225 along the second flow path 250 from the second inlet opening 246 to the second outlet opening 248.

In the illustrated exemplary embodiment, at least one compression ramp 176 is positioned within each flow channel 210. Specifically, compression ramp 176 is positioned between the first inlet opening 230 and the first outlet opening 232, and is sized, shaped, and oriented to generate during operation, one or more oblique shockwaves 258 within each flow channel 210. Similarly, at least one compression ramp 198 (also shown in FIG. 6) is positioned within each flow channel 212. Specifically, the compression ramp 198 is positioned between the second inlet opening 246 and the second outlet opening 248 and is sized, shaped, and oriented to generate one or more oblique shockwaves 259 within each flow channel 212.

During operation of the supersonic compressor rotor 130, intake section 102 (as shown in FIG. 1) directs the first fluid 224 towards the first inlet opening 230 of each flow channel 210. The first fluid 224 has a first velocity, i.e. an approach velocity, just prior to entering first inlet opening 230. The supersonic compressor rotor 130 is rotated about centerline axis 260 at a second velocity, such that the first fluid 224 entering each flow channel 210 has a third velocity i.e. an inlet velocity at the first inlet opening 230 that is supersonic relative to each rotor vane 162. The compression ramp 176 causes an oblique shockwave 258 to form within each flow channel 210, thereby compressing the first fluid 224 to produce the second fluid 225. The second fluid 225 exits each flow channel 210 at supersonic velocity and is directed into at least one second inlet opening 246 such that the second fluid 225 entering at least one flow channel 212 has a fourth velocity (supersonic velocity), i.e. an inlet velocity at the second inlet opening 246. The compression ramp 198 further causes the oblique shockwave 259 to form within each flow channel 212 to further compress the second fluid 225 to produce the further compressed second fluid 226.

Figure 6:
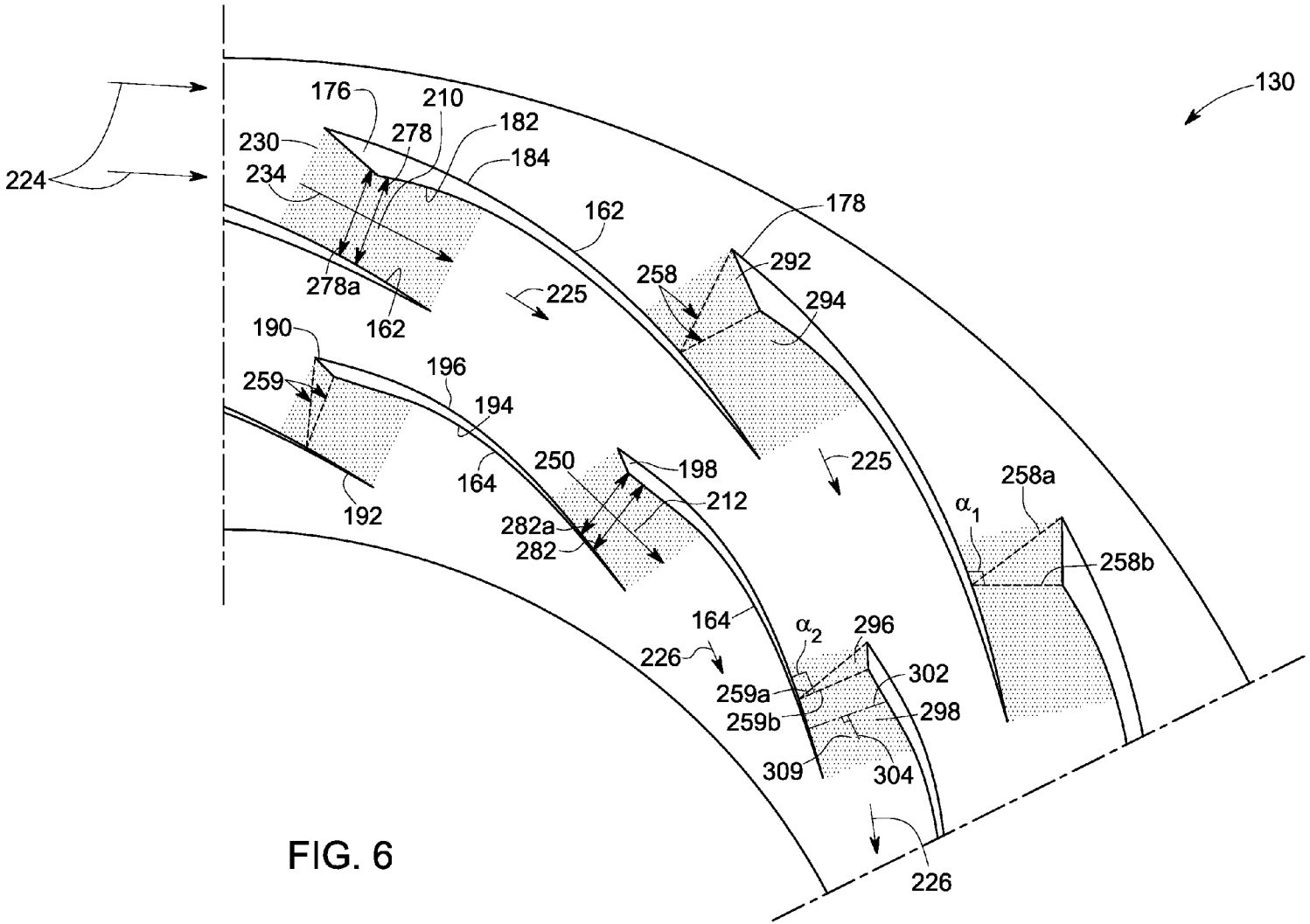
FIG. 6 is a schematic diagram of a portion of a supersonic compressor rotor in accordance with one exemplary embodiment.

FIG. 6 is an enlarged schematic view of a portion of the supersonic compressor rotor 130 in accordance with FIG. 5. Each flow channel 210 has a first cross-sectional area 278 that varies with the width of the flow channel 210 along the first flow path 234. Specifically, each flow channel 210 has a first minimal cross-sectional area 278*a* proximate to an end of the compression ramp 176. It should be noted herein that the term "first minimal cross-sectional area" refers to a minimum width of the flow channel 210, for the first fluid 224 to flow through the flow path 234. The first minimal cross-sectional area 278*a* of each flow channel 210 may also be referred to as a "first throat region".

In the exemplary embodiment, each flow channel 212 has a second cross-sectional area 282 that varies with the width of the flow channel 212 along the second flow path 250. Specifically, each flow channel 212 has a second minimal cross-sectional area 282*a* proximate to an end of the compression ramp 198. It should be noted herein that the term "second minimal cross-sectional area" refers to a minimum width of the flow channel 212, for the second fluid 225 to flow through the flow path 250. The second minimal cross-sectional area 282*a* of each flow channel 212 may also be referred as a "second throat region".

In the illustrated embodiment, the second minimal cross-sectional area 282*a* is smaller than the first minimal cross-sectional area 278*a* so as to further enhance the compression of the second fluid 225 in the flow channel 212. Each flow channel 210 includes a first converging portion 292 and a first diverging portion 294. Each flow channel 212 includes a second converging portion 296 and a second diverging portion 298.

The location of the compression ramps 176, 198 defines throat regions 278*a*, 282*a* of the flow channels 210, 212 of the supersonic compressor rotor 130. In an embodiment, one or more compression ramps 176 may be disposed on the pressure side vane surface 182 of each rotor vane 162. Similarly, one or more compression ramps 198 may be disposed on the pressure side vane surface 194 of each rotor vane 164. In certain other embodiments, each rotor vane 162, 164 may include more than one compression ramps 176, 198 respectively. In such embodiments, the compression ramps 176, 198 may be positioned on either or both rotor vane surfaces 182, 184 and 194, 196.

During operation of the supersonic compressor rotor 130, the first fluid 224 is directed into the first inlet opening 230 at a relative velocity, which is supersonic. The first fluid 224 entering each flow channel 210, contacts the compression ramp 176 to generate the oblique shockwave 258 at the leading edge 178 of each rotor vane 162. Specifically, a first oblique shockwave 258*a* contacts the surface of adjacent rotor vane 162 and a second oblique shockwave 258*b* is reflected back therefrom at an oblique angle $\alpha_1$.

As the first fluid 224 passes through the first flow channel 210, i.e. through the first converging portion 292 and the first diverging portion 294, the velocity of the first fluid 224 may be marginally reduced but remains supersonic. The pressure of the first fluid 224 is increased generating the second fluid 225. The second fluid 225 enters at least one flow channel 212 via the second inlet opening 246 (as shown in FIG. 5), and contacts compression ramp 198 to generate the oblique shockwave 259 at the leading edge 190 of each rotor vane 164. Specifically, a third oblique shockwave 259*a* is generated by compression ramp 198 and a fourth oblique shockwave 259*b* is reflected back from the surface of adjacent rotor vane 164 at an oblique angle $\alpha_2$. The pressure of the second fluid 225 is increased generating the further compressed second fluid 226.

As the second fluid 225 passes through at least one flow channel 212 i.e. in the second diverging portion 298, a normal shockwave 302 is generated in each flow channel 212. Then, the second fluid 225 flows into a subsonic diffusion zone 309, thereby generating a subsonic flow of the second fluid 225. It should be noted herein that the normal shockwave 302 is oriented along a perpendicular direction 304 relative to the second flow path 250, resulting in reduction of the velocity of the second fluid 225 to a subsonic velocity. In some other embodiments, the normal shockwave 302 may not be generated depending on the design and operating condition of the supersonic compressor 100. In one embodiment, the operating condition is defined by a discharge pressure or a back pressure of the supersonic compressor 100. Specifically, when the discharge pressure increases, the normal shockwave 302 may tend to move upstream from the trailing edge 192 to the second throat region 282*a* and when the discharge pressure decreases, the normal shockwave 302 may not be generated.

Conventionally, use of a single set of longer rotor vanes results in a strong interaction of a boundary layer with normal shock waves. In accordance with the embodiments of the present invention, provision of two sets of relatively shorter rotor vanes 162, 164 instead of a single set of longer rotor vane, results in generation of weak oblique shockwaves 258, 259, thereby reducing the pressure losses. Additionally, the supersonic compressor rotor 130 having the two sets of rotor vanes 162, 164 results in formation of thinner boundary layers and thereby making the boundary layers more resistant to separation due to a weaker interaction with the normal shock waves 302 and hence resulting in lower pressure losses.

Figure 7A:
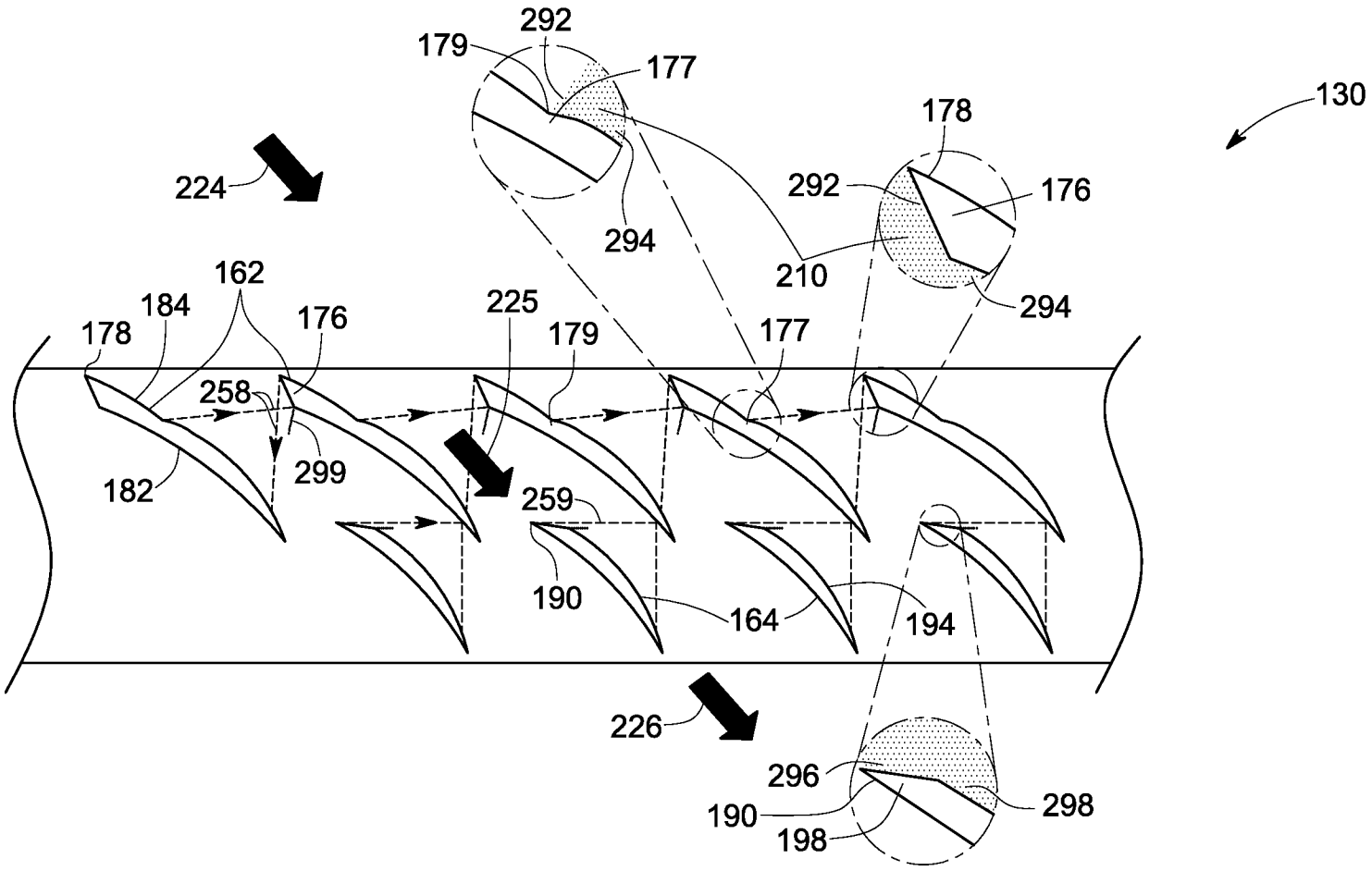
FIG. 7A is a schematic diagram of a portion of a supersonic compressor rotor in accordance with one exemplary embodiment.

FIG. 7A is a schematic diagram of a portion of the supersonic compressor rotor 130 in accordance with an exemplary embodiment. It should be noted herein that the supersonic compressor rotor 130 is shown in the form of an open strip for illustration and explanation purposes.

In the illustrated exemplary embodiment, each rotor vane 162 includes two compression ramps 176, 177. Specifically, compression ramp 176 is disposed on the pressure side vane surface 182 and compression ramp 177 is disposed on the suction side vane surface 184. More specifically, compression ramp 176 is positioned at the leading edge 178 and compression ramp 177 is positioned at a mid-region 179 of each rotor vane 162. Each rotor vane 164 includes the compression ramp 198 at the leading edge 190 of the pressure side vane surface 194. It should be noted herein that the term "pressure side vane surface" refers to the longer surface of a rotor vane and the term "suction side vane surface" refers to the shorter surface of the rotor vane. Fluid pressure at the pressure side vane surface is higher than fluid pressure at the suction side vane surface. The second converging portion 296 of each flow channel 212 (as shown in FIG. 6) is located opposite to the first converging portion 292 of each flow channel 210 so as to further enhance the compression of the second fluid 225 by generating additional oblique shockwaves 259 which are further reflected into each flow channel 212 from adjacent rotor vanes 162.

In the illustrated exemplary embodiment, the compression ramp 176 is configured to generate the oblique shockwave 258 in response to the flow of the first fluid 224 so as to produce the second fluid 225. The second fluid 225 is expanded to generate an expanded second fluid 299, as the second fluid 225 passes through the first diverging portion 294. The compression ramp 177 is configured to generate an additional oblique shockwave 258 in response to the flow of the first fluid 224 so as to reduce the expansion of the second fluid 225 exiting the first diverging portion 294.

Figure 7B:
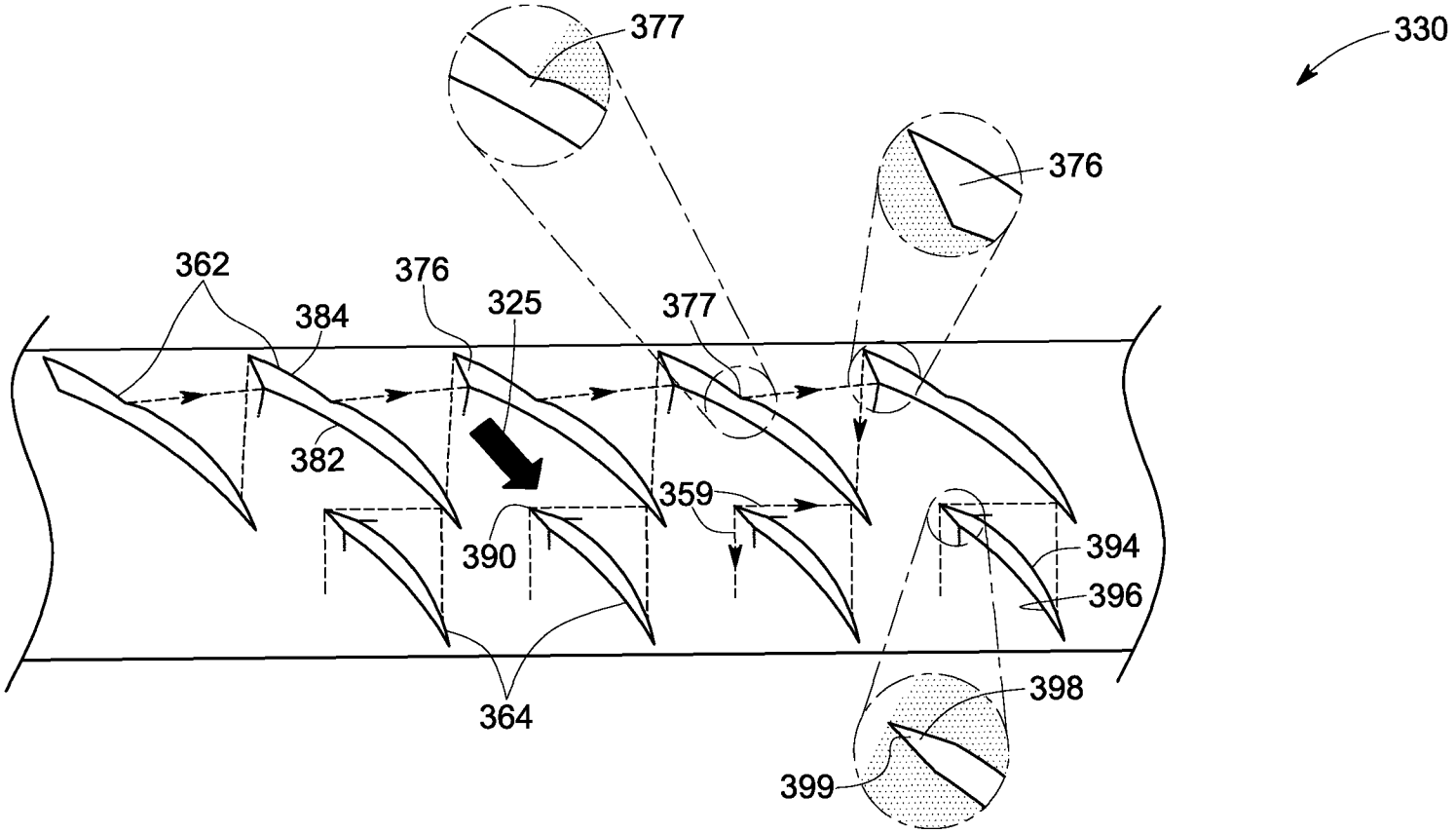
FIG. 7B is a schematic diagram of a portion of a supersonic compressor rotor in accordance with another exemplary embodiment.

FIG. 7B is an open strip view of a portion of a supersonic compressor rotor 330 in accordance with another exemplary embodiment. In the illustrated exemplary embodiment, each rotor vane 362 comprises two compression ramps 376, 377 and each rotor vane 364 also comprises two compression ramps 398, 399. Specifically, compression ramp 376 is disposed on a pressure side vane surface 382 and compression ramp 377 is disposed on a suction side vane surface 384 of each rotor vane 362. The compression ramp 398 is disposed on a pressure side vane surface 394 and compression ramp 399 is disposed on a suction side vane surface 396 of each rotor vane 364. More specifically, compression ramp 398 is positioned proximate to the leading edge 390 at the pressure side vane surface 394 and the compression ramp 399 is also positioned proximate to the leading edge 390 at the suction side vane surface 396.

The compression ramps 398, 399 are configured to generate the oblique shockwaves 359 at the leading edge 390 on both the pressure side vane surface 394 and suction side vane surface 396, in response to a flow of a second fluid 325. Such oblique shockwaves 359 further enhances compression of the second fluid 325 in between the rotor vanes 364 which are further reflected from adjacent rotor vanes 362.

In accordance with the embodiments of the present invention, the supersonic compressor of the present disclosure can achieve higher pressure ratios by further compressing the compressed fluid between the second set of rotor vanes. The provision of the first set and second set of rotor vanes of the supersonic compressor rotor results in lower pressure losses between the rotor vanes, thereby increasing the efficiency of the supersonic compressor.

The invention claimed is:

1. A supersonic compressor rotor comprising:

a first rotor disk;

a second rotor disk;

a first set of rotor vanes coupled to and disposed between the first and the second rotor disks and defining together with the first and the second rotor disks, a first set of radial flow channels;

a second set of rotor vanes coupled to and disposed between the first and the second rotor disks and defining together with the first and the second rotor disks, a second set of radial flow channels, wherein the first set of rotor vanes is disposed offset from the second set of rotor vanes, wherein the first set of radial flow channels and the second set of radial flow channels are configured such that each flow channel of the first set of radial flow channels is in fluid communication with at least one flow channel of the second set of radial flow channels a plurality of compression ramps located in each of the first and second flow channels configured such that each compression ramp is disposed on a rotor vane surface opposite an adjacent rotor vane surface; and, wherein each flow channel of the first set of radial flow channels comprises a first cross-sectional area proximate to an end of each compression ramp located in the first flow channel, wherein each flow channel of the second set of radial flow channels comprises a second cross-sectional area proximate an end of each compression ramp located in the second flow channel, and wherein the second cross-sectional area is smaller than the first cross-sectional area.

2. The supersonic compressor rotor of claim 1, wherein the second rotor disk comprises an end wall coupled to a drive shaft via a plurality of rotor support struts.

3. The supersonic compressor rotor of claim 1, wherein each rotor vane of the first set and the second set of rotor vanes, comprises a leading edge and a trailing edge, wherein the leading edge of each rotor vane of the second set of rotor vanes is disposed proximate to the trailing edge of an adjacent rotor vane of the first set of rotor vanes.

4. The supersonic compressor rotor of claim 3, wherein the leading edge of each rotor vane of the first set of rotor vanes is disposed proximate to a first radial surface of each rotor disk of the first and the second rotor disks.

5. The supersonic compressor rotor of claim 3, wherein the trailing edge of each rotor vane of the second set of rotor vanes is disposed proximate to a second radial surface of each rotor disk of the first and the second rotor disks.

6. The supersonic compressor rotor of claim 1, wherein a number of rotor vanes of the first set of rotor vanes is equal to a number of rotor vanes of the second set of rotor vanes.

7. The supersonic compressor rotor of claim 1, wherein a number of rotor vanes of the first set of rotor vanes is not equal to a number of rotor vanes of the second set of rotor vanes.

8. The supersonic compressor rotor of claim 1, wherein at least one rotor vane of the first set and the second set of rotor vanes comprises only one compression ramp.

9. The supersonic compressor rotor of claim 1, wherein each rotor vane of the first and second set of rotor vanes comprises at least two compression ramps.

10. The supersonic compressor rotor of claim 9, wherein the at least two compression ramps are disposed on at least one surface of a pressure side vane surface and a suction side vane surface of each rotor vane.

11. A supersonic compressor, comprising:

a casing having a fluid inlet and a fluid outlet;

a rotor shaft;

at least one supersonic compressor rotor disposed within the casing, the supersonic compressor rotor comprising:

a first rotor disk;

a second rotor disk coupled to the first rotor disk and the rotor shaft;

a first set of rotor vanes coupled to and disposed between the first and the second rotor disks and defining together with the first and the second rotor disks, a first set of radial flow channels;

a second set of rotor vanes coupled to and disposed between the first and the second rotor disks and defining together with the first and the second rotor disks, a second set of radial flow channels, wherein the first set of rotor vanes is disposed offset from the second set of rotor vanes, wherein the first set of radial flow channels and the second set of radial flow channels are configured such that each flow channel of the first set of radial flow channels is in fluid communication with at least one flow channel of the second set of radial flow channels a plurality of compression ramps located in each of the first and second flow channels configured such that each compression ramp is disposed on a rotor vane surface opposite an adjacent rotor vane surface; and, wherein each flow channel of the first set of radial flow channels comprises a first cross-sectional area proximate to an end of each compression ramp located in the first flow channel, wherein each flow channel of the second set of radial flow channels comprises a second cross-sectional area proximate an end of each compression ramp located in the second flow channel, and wherein the second cross-sectional area is smaller than the first cross-sectional area.

12. The supersonic compressor of claim 11, wherein each rotor vane of the first set and the second set of rotor vanes, comprises a leading edge and a trailing edge, wherein the leading edge of each rotor vane of the second set of rotor vanes is disposed proximate to the trailing edge of an adjacent rotor vane of the first set of rotor vanes.

13. The supersonic compressor of claim 11, wherein at least one rotor vane of the first set and the second set of rotor vanes comprises only one compression ramp.

14. The supersonic compressor of claim 11, wherein each rotor vane of the first and second set of rotor vanes comprises at least two compression ramps.

15. A method of compressing a fluid comprising:

introducing a first fluid into at least one flow channel of a first set of radial flow channels of a supersonic compressor rotor configured to be driven by a shaft;

performing a first compression of the first fluid in the at least one flow channel of the first set of radial flow channels, to produce a second fluid;

introducing the second fluid into at least one flow channel of a second set of radial flow channels of the supersonic compressor rotor; and performing a second compression of the second fluid in the at least one flow channel of the second set of radial flow channels, to produce a further compressed second fluid, wherein the further compressed second fluid is characterized by a higher pressure than the second fluid, wherein the first set of radial flow channels is defined by adjacent rotor vanes of a first set of rotor vanes, wherein the second set of radial flow channels is defined by adjacent rotor vanes of a second set of rotor vanes, wherein each flow channel of the first set and the second set of radial flow channels is further defined by a compression ramp disposed on a rotor vane surface opposite an adjacent rotor vane surface, wherein the first set and the second set of rotor vanes are coupled to and disposed between a first rotor disk and a second rotor disk, wherein each flow channel of the first set of radial flow channels comprises a first cross-sectional area disposed in the first flow channel, wherein each flow channel of the second set of radial flow channels comprises a second cross-sectional area proximate an end of each compression ramp disposed in the second flow channel, and wherein the second cross-sectional area is smaller than the first cross-sectional area.

16. The method of claim 15, wherein the performing the first compression comprises generating an oblique shockwave from each compression ramp in response to a flow of the first fluid through each flow channel of the first set of radial flow channels.

17. The method of claim 16, wherein the performing the second compression comprises generating another oblique shockwave from each compression ramp in response to a flow of the second fluid through each flow channel of the second set of radial flow channels.

* * * * *